US007688948B2

(12) United States Patent
Jonkers et al.

(10) Patent No.: US 7,688,948 B2
(45) Date of Patent: Mar. 30, 2010

(54) METHOD AND APPARATUS FOR GENERATING RADIATION IN THE WAVELENGTH RANGE FROM ABOUT 1 NM TO ABOUT 30 NM, AND USE IN A LITHOGRAPHY DEVICE OR IN METROLOGY

(75) Inventors: Jeroen Jonkers, Aachen (DE); Dominik Marcel Vaudrevange, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 331 days.

(21) Appl. No.: 11/719,881

(22) PCT Filed: Nov. 18, 2005

(86) PCT No.: PCT/IB2005/053810

§ 371 (c)(1),
(2), (4) Date: May 22, 2007

(87) PCT Pub. No.: WO2006/056917

PCT Pub. Date: Jun. 1, 2006

(65) Prior Publication Data

US 2009/0168967 A1 Jul. 2, 2009

(30) Foreign Application Priority Data

Nov. 29, 2004 (EP) ..... 04106131

(51) Int. Cl.
*H05G 2/00* (2006.01)

(52) U.S. Cl. ..... 378/119; 250/504 R

(58) Field of Classification Search ..... 378/119; 250/504 R

See application file for complete search history.

(56) References Cited

U.S. PATENT DOCUMENTS

| | | | | |
|---|---|---|---|---|
| 4,771,447 | A | 9/1988 | Saitoh et al. | |
| 6,389,106 | B1 * | 5/2002 | Neff et al. | 378/122 |
| 6,411,045 | B1 | 6/2002 | Nerone | |
| 6,577,512 | B2 | 6/2003 | Tripathi et al. | |
| 6,847,169 | B2 | 1/2005 | Ito et al. | |
| 6,858,994 | B2 | 2/2005 | Vollrath | |
| 2002/0130280 | A1 * | 9/2002 | Reber | 250/504 R |
| 2004/0109151 | A1 * | 6/2004 | Bakker et al. | 250/504 R |
| 2006/0017024 | A1 * | 1/2006 | Chandhok et al. | 250/504 R |

FOREIGN PATENT DOCUMENTS

| | | | |
|---|---|---|---|
| EP | 0387838 | A2 | 9/1990 |
| EP | 1248499 | A1 | 10/2002 |
| JP | 63304597 | A * | 12/1988 |
| JP | 03201399 | A * | 9/1991 |
| JP | 2005276605 | A | 10/2005 |
| WO | WO9929145 | A1 | 6/1999 |

* cited by examiner

*Primary Examiner*—Chih-Cheng G Kao

(57) ABSTRACT

A method and an apparatus generate radiation in the wavelength range from about 1 nm to about 30 nm by an electrically operated discharge, which can be used in lithography or in metrology. A working gas is provided between two electrodes. Plasma is ignited in the working gas to generate radiation which is forwarded via an opening for further use. Debris particles are produced in at least one region of at least one of the electrodes. To retain the debris particles, the region is arranged with respect to the opening in such a way that movement paths of the debris particles run at least predominantly outside an area delimited by the opening.

26 Claims, 6 Drawing Sheets

METHOD AND APPARATUS FOR GENERATING RADIATION IN THE WAVELENGTH RANGE FROM ABOUT 1 NM TO ABOUT 30 NM, AND USE IN A LITHOGRAPHY DEVICE OR IN METROLOGY

The present invention relates to a method and an apparatus for generating radiation in the wavelength range from about 1 nm to about 30 nm by means of an electrically operated discharge, for which use is made of at least one first electrode and at least one second electrode at a distance therefrom, wherein a working gas is provided between the electrodes and a plasma is ignited in the working gas, the generated radiation of which plasma is forwarded via a first opening for further use, and wherein debris particles are produced in at least one region of at least one of the electrodes. The invention moreover relates to a use of the method and/or of the apparatus in a lithography device or in metrology.

Such generic methods and devices are known from EP 1 248 499 A1. A discharge space is at least partially delimited by at least one anode and one cathode, which are electrically connected to a power supply. A working gas is introduced into the discharge space, the latter also being referred to as the electrode gap.

It is known from WO-A 99/29145 that an insulator is arranged directly between the spaced-apart electrodes and the insulator burn-up is reduced during the discharge mode. A sufficiently large distance between plasma spot and insulator is achieved by virtue of a complex electrode geometry.

The inventors also know of a generic method in which a laser beam or energy beam vaporizes a supplied medium in a predefined region where a first and second electrode are at a small distance from one another. The vapor is ignited to form a plasma which is the source of an extreme ultraviolet radiation or soft X-ray radiation that is to be generated.

Upon reaching an operating point which is defined by the electrode spacing and a partial pressure for the working gas, a plasma is ignited when a breakdown voltage is reached. The ignited plasma is supplied with electrical energy via the electrodes, wherein the plasma is heated to temperatures of several tens of eV, so that the plasma emits radiation in the wavelength range from 1 to 30 nm. The radiation in this wavelength range is hereinafter referred to as EUV or soft X-ray radiation. The energy beam in this case comprises both an energy-rich radiation of the plasma and also a corpuscular radiation. The corpuscular radiation is produced for example by electrode erosion which naturally occurs as current flows through. The radiation is emitted for example by a Z-plasma pinch in all spatial directions. The radiation can finally be coupled out of the electrode gap via a first opening.

Particularly when using the radiation thus generated for EUV lithography or for metrology, at least some of the radiation leaving the discharge space is forwarded through the first opening for further use. The use may also involve a determination of the intensity of the radiation by means of a measurement device, in order to set at least one operating parameter during operation of an above-described radiation source, such as the partial pressure in the discharge space for example.

It is particularly disadvantageous for such radiation sources that debris particles are produced in at least one region of at least one of the electrodes, which debris particles can deposit on surfaces when leaving the electrode gap and/or soil and/or damage a workpiece to be irradiated for example. The debris particles comprise particles, droplets or the like consisting of atoms, molecules or clusters which, following deposition on a collector for example, may considerably shorten the service life thereof since the deposit can permanently cause a shadow on the reflective surface. If the particles reach the collector with a high kinetic energy, the reflective surface may also be damaged by so-called sputtering.

It is therefore an object of the invention to provide an apparatus and a method having the abovementioned features, in which debris particles formed during operation of the radiation source are at least for the most part retained by the electrodes or regions of the electrodes.

According to the invention, this object is achieved in a method of the abovementioned type in that at least the region is arranged with respect to the first opening in such a way that the movement paths of the debris particles run at least predominantly outside an area delimited by the first opening.

For the present invention, it is particularly important that the debris particles leave the electrode in a directional manner for example when current is transmitted. The region of the at least one electrode forms a starting point for the movement paths of the debris particles. As the basis of the debris particles that are produced, the starting point can be spatially positioned with respect to the first opening in such a way that the movement paths run for example parallel to the area of the first opening.

In order to retain most of the debris particles, in the method a current origin of a current flow which is transmitted between the electrodes is arranged in a region of at least one electrode. This region may thus also comprise the current origin of both electrodes, which provide the basis for debris particles.

In the simplest case, this basis defines a virtual plane. The second electrode is arranged with respect to the first electrode in such a way that it is intersected by this virtual plane. This plane delimits an area in which the debris particles released by energy radiation can occur. Consequently, the particles also of the second electrode are prevented from reaching the first opening.

With particular advantage, the method can be carried out such that an energy beam, in particular having a temporally variable intensity, is oriented toward the region of at least one of the electrodes in such a way that a high energy is transmitted into the region.

In order to intermittently ignite the plasma and/or to introduce the working gas when necessary into the discharge space, an energy beam, for example in the form of light, is directed onto one electrode. The light beam may for this purpose be continuous or pulsed, that is to say have an intensity which varies over time. The region may define part of the surface, for example with a punctiform or linear focusing of the energy beam, and is the base of an area extending into the electrode gap in which the debris particles occur.

In particular, one advantageous embodiment of the method provides that a light beam is used as the energy beam.

Another embodiment of the method provides that the region is arranged such that at least one insulator present between the electrodes is positioned outside the movement paths of the debris particles that are produced.

Of course, the retained debris particles deposit on parts of the electrodes and/or insulators which intersect the movement paths. In the event of pronounced electrode erosion and in the case of the insulator, this may lead to an electrical connection of the two electrodes, so that a short-circuit arising as a result has to be eliminated in a complicated manner. By positioning the insulator outside the movement paths, the short-circuit can be prevented and the service life can be increased.

Typically, the movement paths of the debris particles start close to the surface of the electrode which releases them and run in an area delimited thereby. Most of the debris particles consequently move away from the surface, whereas the energy beam strikes the surface. One advantageous embodiment of the method provides that the current flow and/or the energy beam is oriented in the direction of the first opening, toward a side of the electrodes which is remote from the first opening.

The side of the electrode which is remote from the first opening may be arranged, for example by placing at least the region of the electrode which is acted upon by the current flow and/or the energy beam transversely with respect to the first opening, in such a way that the debris particles released at an electrode surface move away from the first opening on their movement paths. This also applies in particular in respect of a region of an electrode used as an anode, said region being referred to as the anode spot.

According to one particularly advantageous embodiment of the method, it is provided that at least one of the electrodes is brought to a temperature which is higher than or more or less equal to the melting temperature of the working gas. In other words, it is ensured that the material which wets the electrodes remains liquid.

This is to be understood below as the melting point of a material which provides the working gas.

Both the material removed from the electrodes by the current flow and/or the energy beam and the working gas which during operation deposits on other points of the electrodes may lead to a change in the electrodes. If, for example, the distance between the first and second electrode is reduced on account of debris particles being deposited on colder spots of the electrode surface, the operating point may be shifted under otherwise constant conditions. Reliable ignition of the plasma may be negatively affected in particular at high repetition rates for plasma formation of around a few kHz and more. By virtue of at least intermittent tempering of the electrodes to the melting temperature of the working gas, the material in liquid form can be both supplied to an area which is at risk of erosion by energy radiation and also removed from areas of the electrode which have been affected by deposition. Of course, the insulator may also possibly be brought to a corresponding temperature. Upon reaching the melting point of the working gas, the deposited material forms a mobile liquid phase.

Advantageously, the method is carried out such that the current flow and/or the energy beam is oriented toward the region where the electrodes are at a small distance from one another.

By virtue of the small distance of the electrodes from one another, the plasma is ignited starting from the region acted upon by the energy beam, along electrical field lines which form more or less at the shortest connecting line between the electrodes. A starting point for the erosion of electrode material can thus be defined in such a way that the debris particles formed there cannot reach the first opening.

According to another advantageous embodiment of the method according to the invention, it is provided that the radiation is passed to an optical device which is arranged in the propagation direction of the radiation and outside the movement paths of the debris particles.

The optical device comprises, without the invention being restricted thereto, a mirror, a grid, a collector, a foil trap, a monochromator, a photodiode, a reflective, absorbing surface, or a combination thereof.

Starting from the plasma origin, the radiation will run in a straight line in all spatial directions, wherein only an area with a solid angle, for example a conical area, is used to forward the radiation through the first opening to the optical device. The solid angle is defined here by the plasma origin as the apex and a surface which touches an edge of the first opening or part thereof. The first opening may be dimensioned in such a way that a relatively large amount of the EUV radiation generated by the plasma can be forwarded, wherein, by choosing a suitable distance between the plasma and the first opening, the first opening does not intersect the movement paths of the debris particles.

The plasma spot usually lies close to the electrode which serves as cathode. In order to form a conductive channel, the region which is acted upon by the energy beam can then be provided on the cathode in order to achieve preionization of the working gas. One advantageous method therefore provides that the region is arranged on a depression or a protrusion of the first electrode.

The debris particles released during operation are released close to the current origin and/or close to the region which is acted upon by the energy beam and are oriented for example by an almost funnel-shaped depression in such a way that the movement paths thereof are oriented outside the first opening and the optical device. By means of the protrusion, said debris particles having a movement path in the propagation direction of the radiation and/or in the direction of the first opening are deflected, deposited on the protrusion or slowed down on account of impacts. The debris particles cannot leave the electrode gap and/or cannot reach the insulator.

According to one advantageous method, it is provided that the at least one remote side of one electrode is arranged with respect to the other electrode in such a way that a line running along the surface of this remote side meets the surface of the other electrode. In this case, the movement paths of the debris particles occurring in the region of the other electrode can be oriented in such a way that they are intersected by the first electrode prior to reaching the first opening.

It is also an object of the invention to provide an apparatus of the abovementioned type which almost completely prevents the debris particles formed during the discharge mode from exiting through the first opening.

According to the invention, this object is achieved in an apparatus of the abovementioned type in that at least the region is arranged with respect to the first opening in such a way that the movement paths of the debris particles are oriented at least predominantly outside an area delimited by the first opening.

The electrodes used to transmit electrical energy release matter which comprises the working gas and/or particles of electrode material for example which are removed as a result of erosion phenomena. When considering a flat electrode surface with a solid angle of 0 to 2 $\Pi$ in the adjoining space, said particles may move on typically rectilinear movement paths. The radiation generated by the plasma is emitted homogeneously in all spatial directions, so that the first opening can be arranged with respect to the electrodes in such a way that the movement paths of the debris particles do not intersect said opening.

According to one advantageous embodiment of the apparatus, it is provided that a current origin of a current flow which is transmitted between the electrodes is arranged in the region.

By suitably orienting at least the region which is acted upon by electrical energy, the area that can be reached by debris particles can be arranged such that the debris particles cannot reach the first opening and/or cannot leave the volume between the electrodes.

One particularly advantageous apparatus is configured such that an energy beam, in particular having a temporally variable intensity, can be oriented toward one of the electrodes in such a way that a high energy can be transmitted into the region directly or indirectly or by means of the electrode. As a result, a current origin can be defined on at least one of the electrodes. Around the current origin, debris particles are released into the electrode gap. It is thus possible to arrange the movement paths in spatial terms in such a way that they cannot reach the first opening. The energy beam can moreover be oriented toward a part of the electrode which is provided for example on a side of the electrode remote from the discharge space, and the energy passes into the region on account of heat conductivity.

The plasma formation may be configured in a pulsed manner by means of an energy beam having an intensity which varies over time. To this end, an apparatus according to the invention is advantageously designed such that the energy beam is a light beam. A particularly inexpensive laser device having an adjustable frequency, intensity and/or wavelength may be used as the light beam and serve to reduce electrode erosion and the production of debris particles.

Deposits may occur on account of the fact that most debris particles remain in the discharge space. In order to prevent such deposits, the apparatus may be designed in such a way that the region is arranged such that at least one insulator present between the electrodes is positioned outside the movement paths of the debris particles that are produced. The insulator may have any geometric shape and may be arranged in a second opening. The second opening may for example be provided in one of the electrodes. The insulator can then be arranged in an offset manner within the second opening so that the debris particles released by the electrode do not strike the insulator.

Typically, the debris particles have a translation direction which is essentially oriented away from the surface of the electrodes which releases them, whereas the energy beam propagates in the direction toward the surface. Consequently, one particularly advantageous apparatus is designed such that the current flow and/or the energy beam can be oriented in the direction of the first opening, toward a side of the electrodes which is remote from the first opening. The debris particles in this case move on their movement paths away from the first opening.

Since the debris particles predominantly remain in the electrode gap, deposits may also form on the electrodes. Besides a shift in the operating point on the Paschen curve, such deposits may also lead to a current bridge for example on an insulator arranged between the electrodes. One particularly advantageous embodiment of the apparatus therefore provides that at least one of the electrodes is provided with a device for setting the temperature which is higher than or more or less equal to the melting temperature of the working gas.

Any deposits in the electrode gap can thus when necessary be supplied back or carried away as liquid material in the region which is acted upon by the energy beam, which region may also include the current origin, that is to say depending on the deposition rate of the working gas and/or of the electrode material.

According to one particularly advantageous embodiment of the apparatus according to the invention, it is provided that the current flow and/or the energy beam can be oriented toward the region where the electrodes are at a small distance from one another.

The debris particles released close to the region can be retained by the second electrode arranged relatively close to the surface of the first electrode, for example by means of absorption phenomena and/or condensation. The debris particles can as a result not reach the first opening which is arranged for example transversely with respect to the electrode surface of the first electrode.

In order to extend the service life, an apparatus according to the invention may advantageously be designed such that an optical device is arranged behind the first opening, in the propagation direction of the radiation and outside the movement paths of the debris particles.

The first opening is typically dimensioned and arranged such that as large an amount as possible of the radiation emitted by the plasma can be supplied for further use. In particular, the debris particles formed by electrode erosion can leave the electrode gap via the first opening on movement paths along the propagation direction of the radiation. On account of different origins for the radiation and the debris particles, it is possible to position the optical device in a radiation path in such a way that the movement paths of the debris particles do not however reach said optical device.

Reaching or shadowing of and/or damage to the optical device can also be almost completely prevented by means of a relatively large distance between the first opening and the optical device. Moreover, the optical device may also comprise a so-called foil trap which may for example also be provided in the first opening.

The apparatus according to the invention may advantageously be designed such that the region is arranged in a depression or on a protrusion of the electrodes.

The debris particles released into the area by the first electrode during the discharge mode may be deflected, absorbed or slowed down for example by surfaces of the depression or protrusion prior to reaching the first and/or second opening or the optical device.

According to another advantageous apparatus, it may be provided that the at least one remote side of one electrode is arranged with respect to the other electrode in such a way that a line running along the surface of this remote side meets the surface of the other electrode. By arranging the sides of the two electrodes which are provided with the respective region in a manner such that they are offset with respect to one another, it is possible for example for debris particles of the electrode serving as the anode, which migrate at an acute angle to the surface of said electrode, to be retained.

According to one particularly advantageous embodiment of an apparatus according to the invention, it is provided that the electrodes are arranged within a first module.

The first module which accommodates the electrodes may serve as a vacuum chamber and has at least one wall in which there is provided the first opening required for passage of the radiation. Most of the debris particles formed during operation of the apparatus can be retained in the electrode gap. In particular, by integrating all of the components required to generate the radiation in the first module, it is possible for the first module to be rapidly replaced in the event of a malfunction of the apparatus according to the invention, so that maintenance and repair times can accordingly be shortened.

It may be particularly advantageous to design the apparatus in such a way that an energy beam source which provides the energy beam is fixedly or removably arranged on or in the first module. Consequently, the energy beam source can be rapidly replaced and/or positioned at different locations in or on the first module. Moreover, the energy beam can be oriented in the direction of the first opening toward the region of the electrode. The released debris particles predominantly have movement paths which differ from the propagation direction of the radiation leaving the first module.

Advantageously, the apparatus according to the invention is designed such that the optical device is arranged in a second module.

By virtue of a modular design with a first module serving as the radiation source and a second module which accommodates the optical device, it being possible for said modules to be connected to one another via the first opening between the radiation source and the second module, it is possible to provide a light source which can rapidly be adapted to a wide range of applications. By way of example, if necessary, a number of optical devices can be arranged within the second module. If soiling of the optical device occurs for example on account of unfavorable operating states in the first module, it is possible with a low outlay for example for the optical device to be replaced, for a further optical device, e.g. a foil trap, to be added and/or for a greater distance to be set between the first opening and the optical device.

Without restricting the general use of the apparatus according to the invention or of the method according to the invention to the generation of radiation in the wavelength range from about 1 nm to about 30 nm by means of an electrically operated discharge, one advantageous use is provided in a lithography device or in metrology.

The extremely short-wave radiation generated during the discharge mode of the radiation source may be connected for example to a so-called scanner device in order to machine workpieces, for example a wafer, by means of a lithographic process.

The generated radiation can also be used in metrology, for example to analyze the structure of an object by means of a microscope.

The invention will be further described with reference to examples of embodiments shown in the drawings to which, however, the invention is not restricted.

Figure 3:
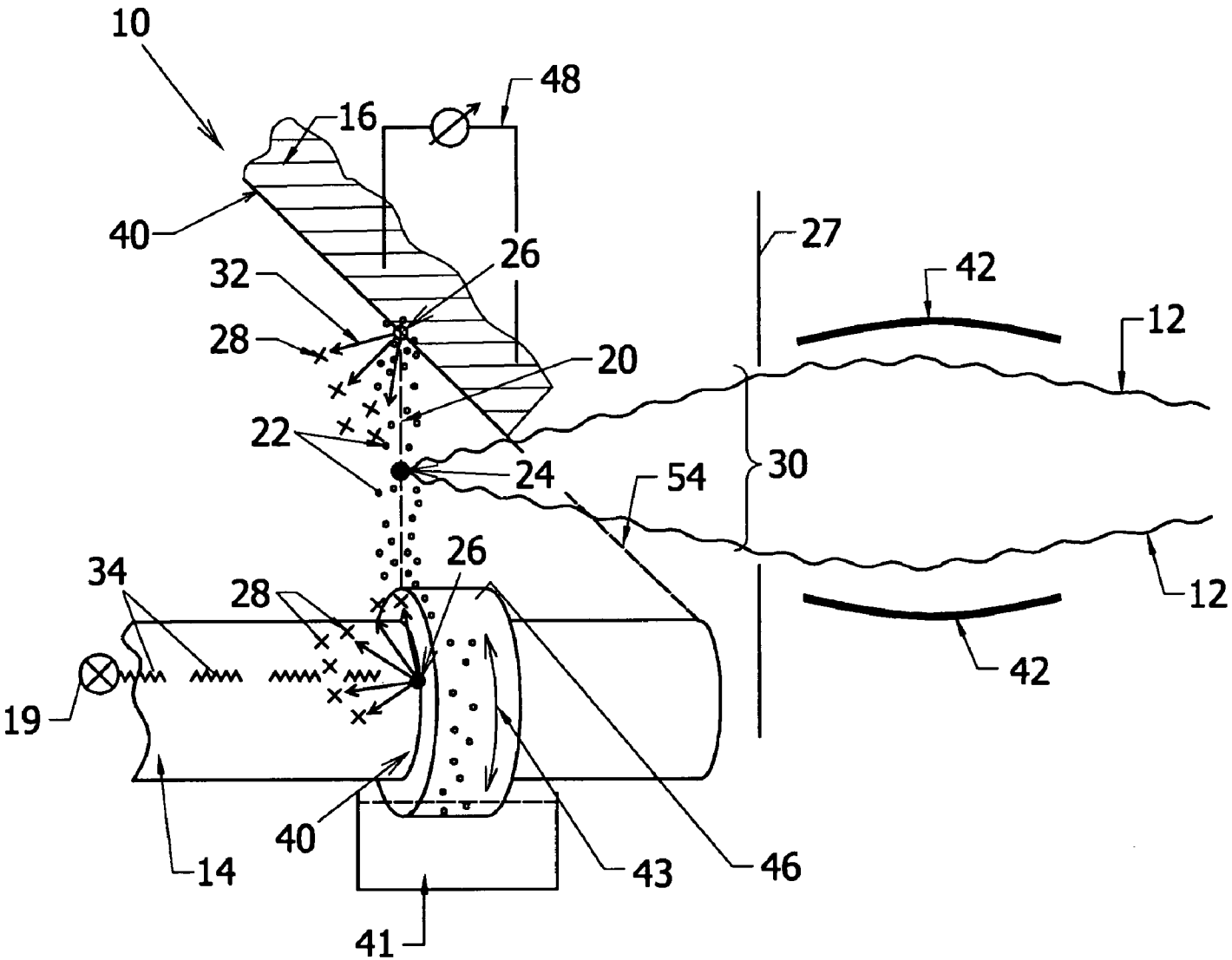
FIG. 3 shows a third example of embodiment of an apparatus, in side view.
Figure 3A:
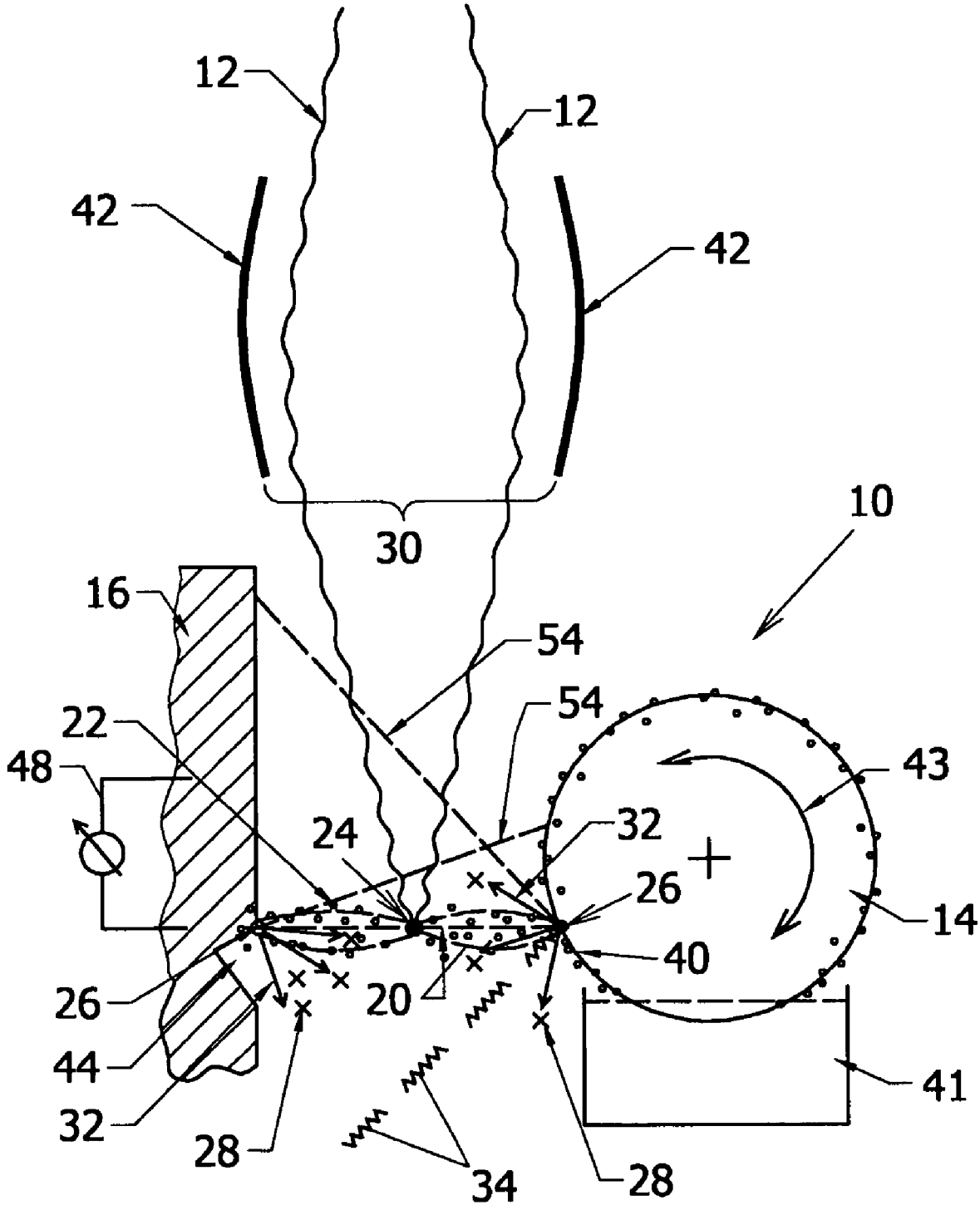

FIG. 3*a* shows a side view of a fourth example of embodiment of an apparatus according to the invention.

Figure 4:
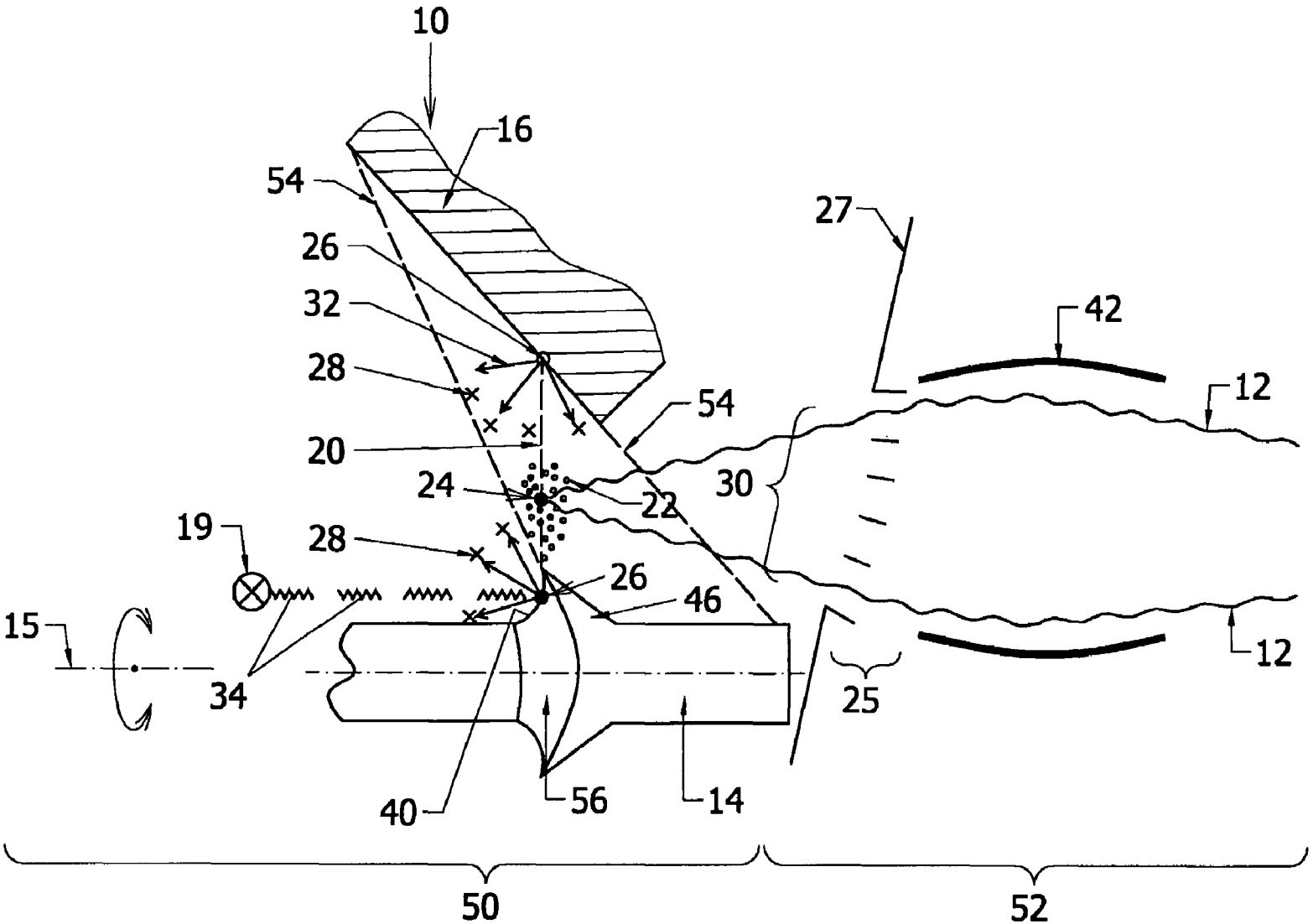

FIG. 4 shows a fifth example of embodiment of an apparatus, in side view.

Figure 5:
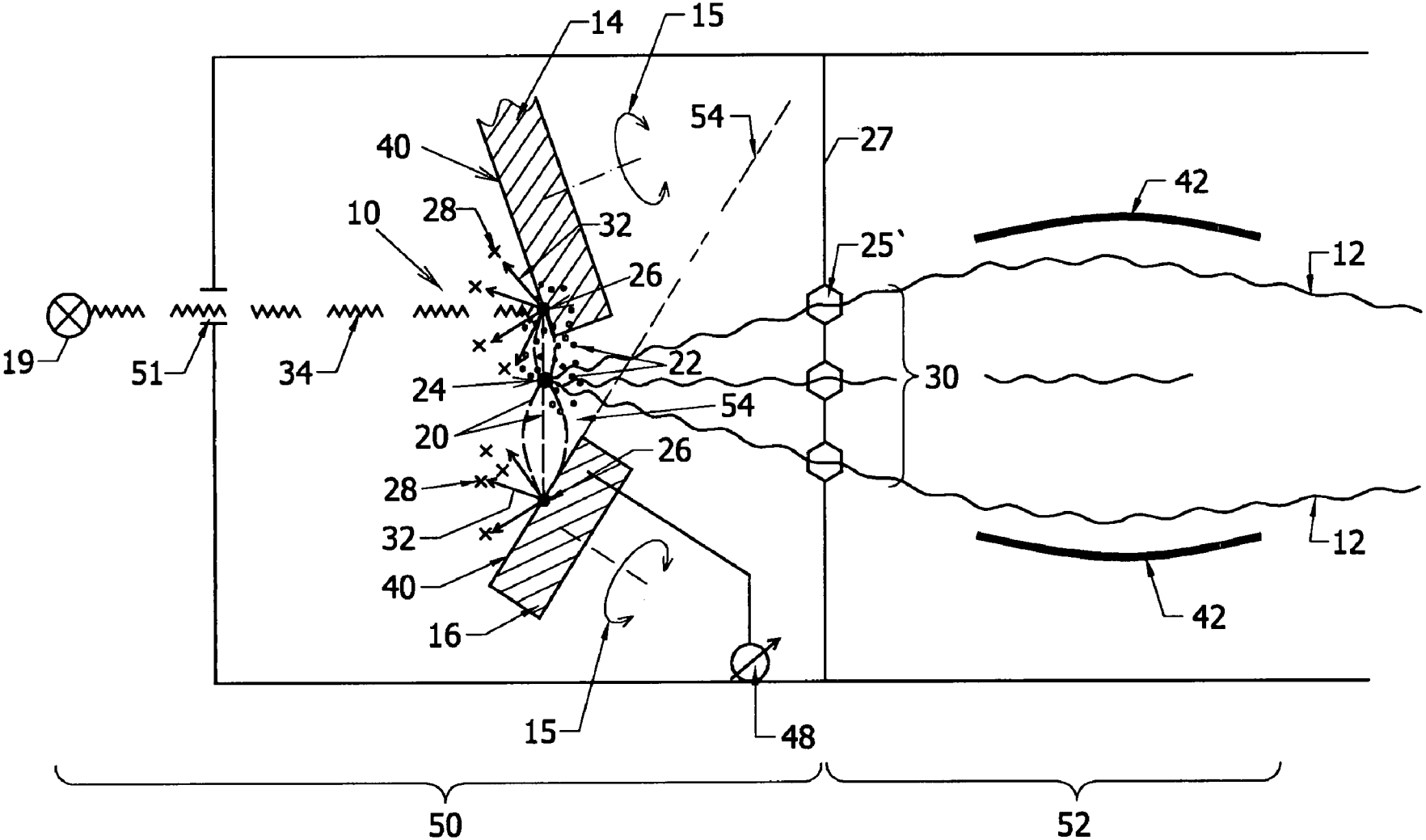

FIG. 5 shows a schematic side view of an apparatus according to a sixth example of embodiment.

A number of examples of embodiments of an apparatus 10 for generating radiation 12 in the wavelength range from about 1 nm to about 30 nm by means of an electrically operated discharge are described with reference to FIGS. 1 to 5. Unless otherwise specified, identical references denote identical, or at least similar, features.

Figure 1:
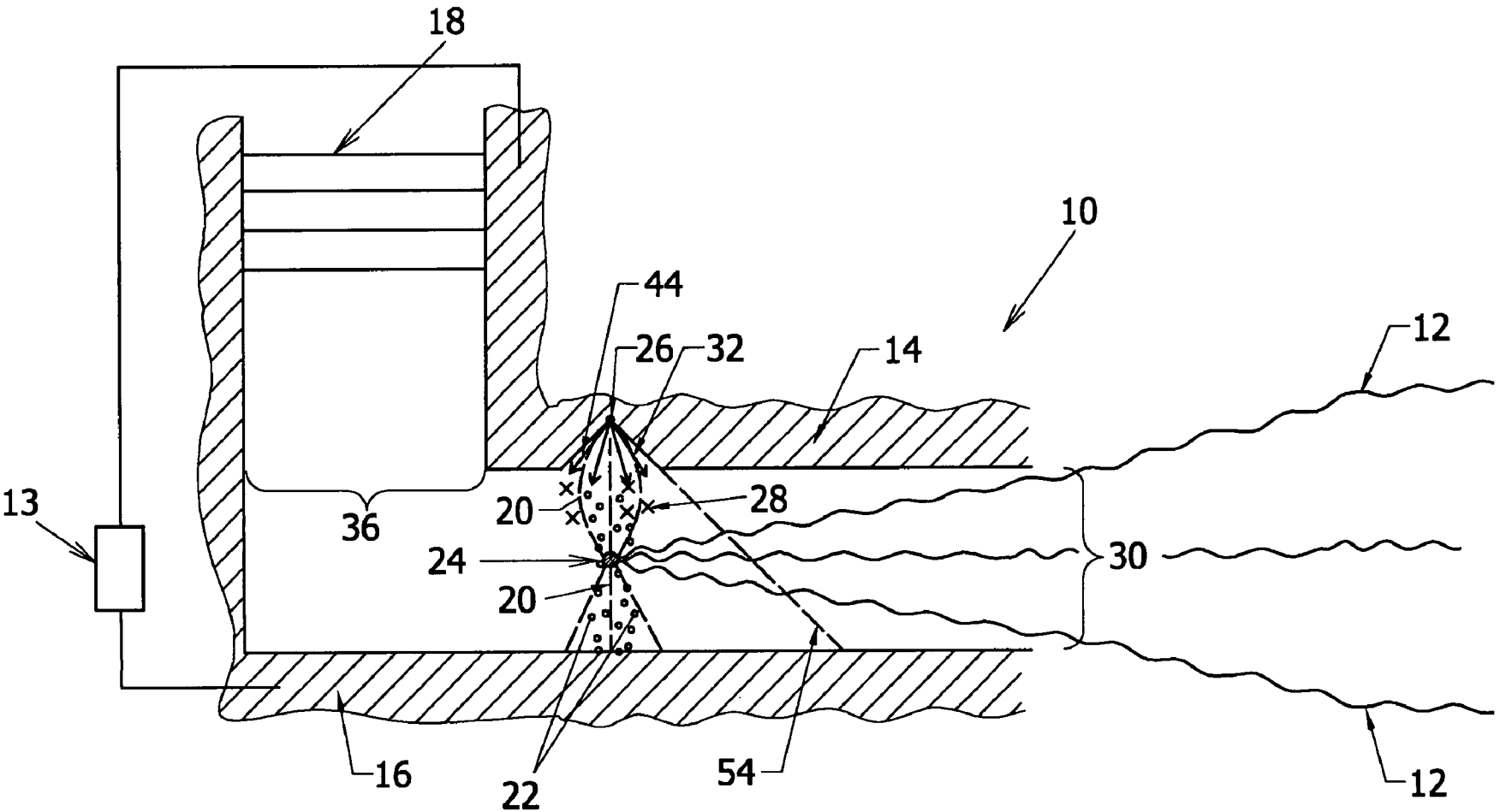
FIG. 1 shows a schematic cross-sectional view of an apparatus according to a first example of embodiment.

With reference to FIG. 1, based on the apparatus 10, there is also described a method of generating radiation 12 in the wavelength range from about 1 nm to about 30 nm by means of an electrically operated discharge, for which use is made of at least one first electrode 14 and at least one second electrode 16.

The electrodes 14 and 16 are electrically connected to one another via a power supply 13, which is configured for example as a bank of capacitors or a pulsed power supply. The first electrode 14 is spaced apart from the second electrode 16, so that an electrode gap is provided in the intermediate space between the electrodes 14, 16. At least one working gas 22 is present in the intermediate space. A plasma 24 is ignited in this working gas 22 under adjustable pressure, temperature, spacing and/or voltage conditions between the first and second electrode 14, 16. Finally, by means of the power supply 13, electrical energy is transmitted into the plasma 24 via an electrode system, which in addition to the electrodes 14, 16 may also comprise a secondary electrode (not shown here). The short-wave radiation 12 is emitted from the plasma 24, at least some of said radiation being forwarded through a first opening 30 for further use.

Of course, when transmitting electrical energy onto the region 26, so-called debris particles 28 are released into the electrode gap. As shown in FIG. 1, at least one region 26 is arranged within a depression 44 of the first electrode 14. Starting from the first electrode 14, the debris particles 28 produced in the region 26 move on the movement paths 32 into the discharge space, said movement paths being shown by arrows. Those debris particles 28 which, by assuming a linear translation movement starting from the region 26, can reach the first opening 30 are oriented by part of the (in this case funnel-shaped) depression 44 in such a way that at least hardly any debris particles 28 actually occur to the right of the dashed line 54 shown in FIG. 1.

Both the debris particles 28 produced in the region 26 and the working gas 22 which vaporizes there thus have movement paths 32 which run at least predominantly outside an area delimited by the first opening 30. The debris particles 28 consequently do not reach the first opening 30. An insulator 18 arranged in a second opening 36 in a manner offset with respect to the first electrode 14 also lies outside the movement paths 32 shown here and between the electrodes 14, 16.

Figure 2:
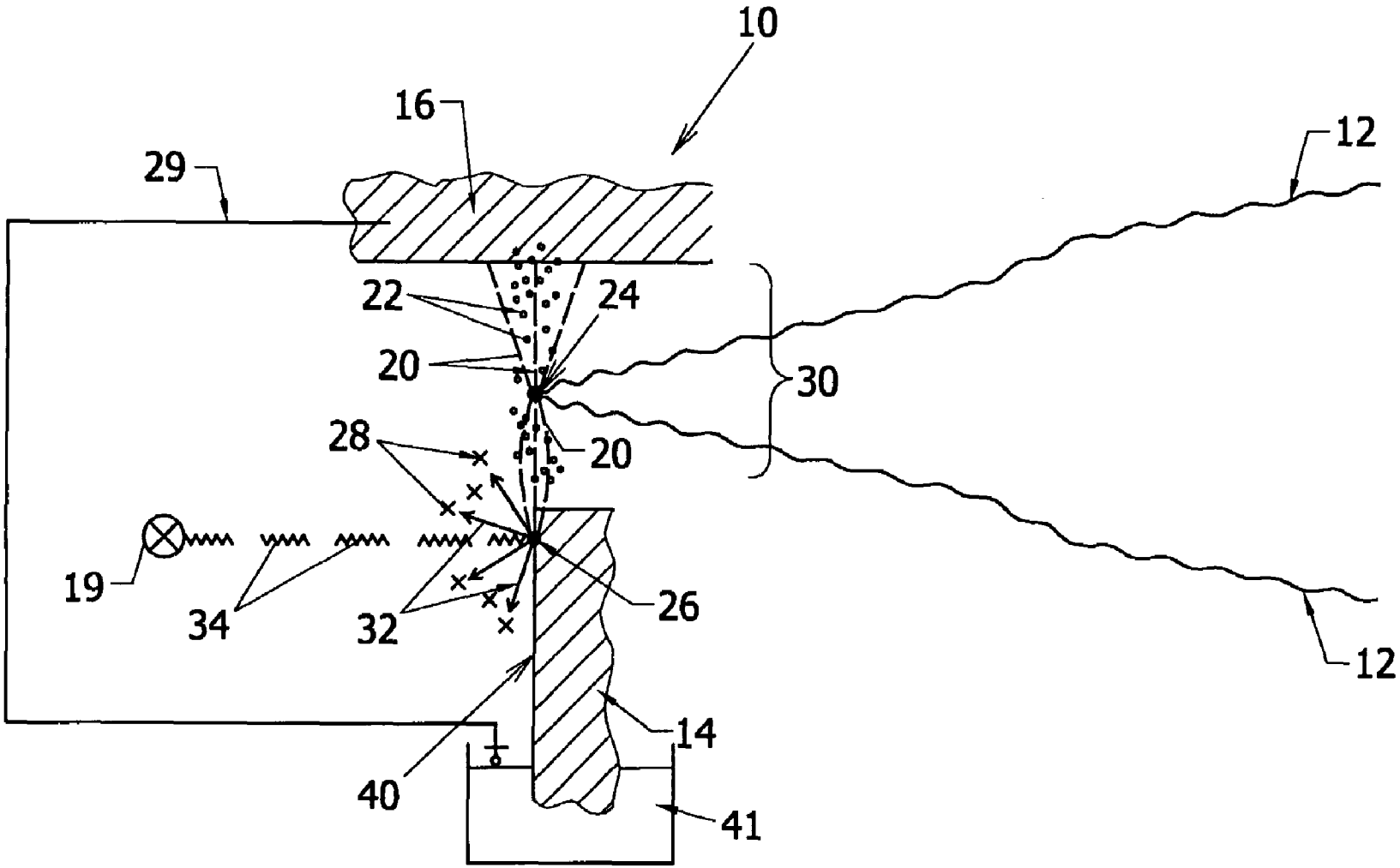
FIG. 2 shows a schematic cross-sectional view of a second example of embodiment of the apparatus according to the invention.

In the second example of embodiment of an apparatus 10 according to the invention, which is shown in FIG. 2, an energy beam 34 generated by means of an energy beam source 19 is oriented toward a region 26 of the first electrode 14. The movement paths 32, as shown by arrows, of the debris particles 28 produced there mainly point away from the opening 30. Moreover, by means of the energy beam 34, a current origin for a current flow 20 transmitted between the electrodes 14, 16 is defined in the region 26.

The first electrode 14 is geometrically shaped and spatially arranged with respect to the second electrode 16 in such a way that its side 40 is remote from the first opening 30. The energy beam 34, which is formed as a pulsed laser beam having a temporally variable intensity, is oriented in the direction of the first opening 30 so that the debris particles 28, starting from the region 26, move away from the first opening 30. The particles of working gas 22 that are released migrate into a space between first electrode 14 and second electrode 16. When there is a sufficiently high current flow 20, a plasma 24 is ignited, the radiation 12 of which plasma can leave a discharge volume via the first opening 30 in order to be supplied for further use. At least some of the working gas 22 and debris particles 28 reach the second electrode 16, wherein these are slowed down and/or condense.

If, during operation of the apparatus 10, the electrodes 14, 16 are brought to a temperature which is higher than or more or less equal to the melting temperature of the working gas 22, material which strikes the second electrode 16 in particular will be diverted in liquid form via a return 29 into a reservoir 41. The electrodes 14, 16 are in this case designed in a sponge-like manner so that a material which serves as a source for the working gas 22 is stored in the reservoir 41 and can be supplied back to the region 26 as required.

In particular, this second example of embodiment of the apparatus 10 is consequently configured such that the region 26 which is acted upon by the current flow 20 and the energy beam 34 is arranged with respect to the first opening 30 in such a way that the movement paths 32 of the debris particles 28 produced there run outside an area delimited by the first opening 30. Typically, a power supply 13 (not shown) serves to place the first electrode 14 at a potential with respect to the second electrode 16 that is electrically connected thereto, such that the first electrode 14 serves as cathode.

FIG. 3 shows a third example of embodiment of the apparatus 10 according to the invention. A region 26 of the first electrode 14 which is particularly at risk of erosion is in this case arranged on a protrusion 46. When the current flow 20 strikes, the debris particles 28 move on their movement paths 32 outside the first opening 30. In order to increase the service life of the first electrode 14, the side 40 thereof which is remote from the first opening 30 is continuously renewed by virtue of a rotational movement 43. The plasma 24 ignited in the working gas 22 lies on a connecting line between the protrusion 46 of the first electrode 14 and the second electrode 16. However, it is also possible that the arrangement of the current flow 20 and plasma 24 shown in FIG. 3 represents the initial state. Starting from this, the arrangement may also migrate toward a connecting line that is as short as possible. This migration may take place either without plasma 24 or with the plasma 24, wherein in the first case the plasma 24 is ignited when the connecting line is as short as possible. By means of a device 48, the temperature of the second electrode 16 is set such that the deposits of debris particles 28 or of particles of the working gas 22 which bring about a reduction in the spacing are evaporated and/or transported away as a mobile liquid phase in the second electrode 16. The device 48 is designed as resistance heating.

Here, the second electrode 16 is arranged transversely with respect to the first electrode 14, so that the debris particles 28 produced by the current flow 20 in a region 26, which is also referred to as the anode spot, do not exit via the first opening 30. The radiation 12 generated by the plasma 24 is passed to an optical device 42 for further use. The optical device 42 is in this case arranged with respect to a wall 27 that delimits the first opening 30 and oriented with respect to the propagation direction of the radiation 12 in such a way that it lies outside the movement paths 32 of the debris particles 28. The side 40 of the second electrode 16 which is remote from the first opening 30 has a line 54 running along its surface, which line is intersected by the first electrode 14. Seen in the propagation direction of the radiation 12, none of the debris particles 28 produced by the second electrode 16 occur behind the line 54.

A fourth example of embodiment of the apparatus 10 according to the invention, which is illustrated in FIG. 3*a*, shows that the region 26 of the first electrode 14 which is acted upon by the current flow 20 and the energy beam 34 is arranged on the side 40 which is remote from the first opening 30. All the movement paths 32 of the debris particles 28 that are produced run in such a way that, in the propagation direction of the radiation 12, said particles cannot reach the optical device 42 on account of a suitable distance between the first opening 30 and the latter. In other words, in the example of embodiment shown in FIG. 3*a*, none of the debris particles 28 produced by the first electrode 14 or particles of working gas 22 occur above the dashed line 54. One surface of the side 40 continuously changes during the discharge mode on account of the rotational movement 43. Moreover, a material which provides the working gas 22, such as a tin-containing chemical compound for example, can be supplied back to the region 26 via the reservoir 41.

The current flow 20 acts upon the second electrode 16 at the point where a depression 44 is located. As a result, the movement paths 32 of the debris particles 28 produced there are oriented outside the first opening 30, wherein a line 54 running along the surface of the depression 44 of the second electrode 16 meets the surface of the first electrode 14.

A fifth example of embodiment of an apparatus 10 shown in FIG. 4 for retaining debris particles 28 is configured in such a way that the electrodes 14, 16 are arranged within a first module 50. During the discharge mode, the first electrode 14 provided with a protrusion 46 is made to move in rotation along a rotation axis 15. The side 40 of the first electrode 14 which is remote from the first opening 30 will thus continuously change, so that a region 26 of a hollow groove 56, which is particularly at risk of erosion and is acted upon by the current flow 20 and a pulsed energy beam 34 and has a small distance from the second electrode 16, is continuously varied. An energy beam source 19 which provides the energy beam 34 is fixedly arranged in the first module 50. The energy beam source 19 is in this case an end of a waveguide.

In particular, the debris particles 28 of the electrodes 14, 16 which are released by the current flow 20 have movement paths 32 which run away from the first opening 30. The electrodes 14, 16 in each case have lines 54 running along their surfaces, said lines in each case meeting the surface of the other electrode 14, 16. Seen in the propagation direction of the radiation 12, volumes which are predominantly free of debris particles 28 are defined to the right of these lines 54.

The debris particles 28 released in the regions 26 have movement paths 32 which, with a common origin on the side 40, virtually as half-lines, do not intersect the optical device 42. The optical device 42 is in this case arranged in a second module 52 which can be connected to the first module 50 via a wall 27. The first opening 30 is made in the wall 27, through which opening the radiation 12 emitted by the plasma 24 is passed for further use. In order to retain debris particles 28, the first opening 30 is provided with a foil trap 25.

As shown in FIG. 5, a sixth example of embodiment of the apparatus 10 according to the invention is configured such that the generated plasma 24 can be generated within a first module 50. The wall 27 of the latter has a first opening 30 for the passage of the radiation 12 generated in the plasma 24. The radiation 12 can be focused by an optical device 42 arranged in a second module 52 in such a way that the radiation 12 can be used for a lithography device (not shown here). Within the first module 50, at least one first electrode 14 and one second electrode 16 are arranged with respect to one another in such a way that a side 40 remote from the first opening 30 covers a plane indicated by the dashed line 54, said plane running outside an area delimited by the first opening 30. On the side 40, a current origin which is acted upon by the current flow 20 is arranged in the region 26 which lies on the shortest connecting line to the second electrode 16. The second electrode 16 is provided with a device 48 for adjusting the temperature, preferably with a cooling means, so that particles of the working gas 22 can be removed during the discharge mode when the melting temperature is reached.

When the energy beam 34 strikes, debris particles 28 and particles of the working gas 22 come from the side 40 of the first electrode 14, and said particles move away from the first opening 30. The movement paths 32 of said particles lie essentially outside the first opening 30, which is provided with a foil trap 25'. Since particularly hot spots are produced on the electrodes 14, 16 during the discharge mode upon ignition of the plasma 24, the second electrode 16 rotates about the rotation axis 15. The current flow 20 strikes the second electrode 16 at the point where its side 40 is remote from the outer contour of the first opening 30.

The energy beam source 19 which generates the energy beam 34 is removably fixed on the first module 50, which is oriented in the form of a monochromatic, pulsed laser beam via an aperture 51 toward the region 26.

A modular source for EUV and/or soft X-ray radiation 12, as shown in FIG. 5, is suitable for use in metrology and lithography.

The present invention provides a method of generating short-wave radiation, in which at least most of the debris particles cannot reach a first opening which is provided for forwarding the generated radiation. The apparatus according to the invention serves to retain debris particles which are released when generating short-wave radiation by means of an electrical discharge. Since hardly any such particles can leave the electrode system, the method and apparatus according to the invention can be used in a lithography device or in metrology.

LIST OF REFERENCES:

10 apparatus
12 radiation
13 power supply
14 first electrode
15 axis of rotation
16 second electrode
18 insulator
19 energy beam source
20 first energy beam
22 working gas
24 plasma
25, 25' foil trap
26 region
27 wall
28 debris particle
29 return
30 first opening
32 movement path
34 second energy beam
36 second opening
40 side
41 reservoir
42 optical device
43 direction of rotation
44 depression
46 protrusion
48 device
50 first module
51 aperture
52 second module
54 line
56 hollow groove

The invention claimed is:

1. A method of generating radiation in the wavelength range from about 1 nm to about 30 nm by an electrically operated discharge between electrodes including at least one first electrode and at least one second electrode for forming an opening delimiting an area, the method comprising the acts of:

igniting at least one working gas provided between the electrodes and a plasma placed in the working gas to generate the radiation and debris particles; and forwarding the generated radiation via the opening for further use;

wherein the debris particles are produced in at least one region of at least one of the electrodes, the at least one region being arranged with respect to the opening in such a way that movement paths of the debris particles run at least predominantly outside the area delimited by the opening substantially preventing the debris particles from reaching the opening.

2. The method as claimed in claim 1, further comprising the act of arranging a current origin of a current flow in the at least one region, wherein the current flow is transmitted between the electrodes.

3. The method as claimed in claim 1, further comprising the act of orienting an energy beam having a temporally variable intensity toward the at least one region of at least one of the electrodes in such a way that a high energy is transmitted directly into the at least one region.

4. The method as claimed in claim 3, further comprising the act of using a light beam as the energy beam.

5. The method as claimed in claim 1, further comprising the act of arranging the at least one region such that at least one insulator present between the electrodes is positioned outside the movement paths of the debris particles.

6. The method as claimed in claim 5, further comprising the act of arranging the at least one remote side of one electrode with respect to the other electrode in such a way that a line running along the surface of this remote side meets the surface of the other electrode.

7. The method as claimed in claim 1, further comprising the act of orienting the current flow and/or the energy beam in a direction of the opening toward a side of the electrodes which is remote from the opening.

8. The method as claimed in claim 1, further comprising the act of bringing at least one of the electrodes to a temperature which is higher than or more or less equal to a melting temperature of the working gas.

9. The method as claimed in claim 1, further comprising the act of orienting the current flow and/or the energy beam toward the at least one region where the electrodes are at a small distance from one another.

10. The method as claimed in claim 1, further comprising the act of passing the radiation to an optical device which is arranged in a propagation direction of the radiation and outside the movement paths of the debris particles.

11. The method as claimed in claim 1, further comprising the act of arranging the at least one region on a depression or a protrusion of the electrodes.

12. The method of claim 1, wherein the generated radiation is applied in at least one of a lithography device and metrology.

13. An apparatus for generating radiation in a wavelength range from about 1 nm to about 30 nm by an electrically operated discharge, the apparatus comprising:

electrodes including a first electrode and a second electrode at a distance, from the first electrode, the first electrode and the second electrode forming an opening delimiting an area;

at least one working gas provided between the first electrode and the second electrode; and a plasma located in and capable to be ignited in the working gas to generate radiation and debris particles, at least some of the generated radiation can be forwarded via the opening for further use, and wherein the debris particles are produced in at least one region of at least one electrode of the electrodes;

wherein the at least one region is arranged with respect to the opening in such a way that movement paths of the debris particles are oriented at least predominantly outside an area delimited by the opening substantially preventing the debris particles from reaching the opening.

14. The apparatus as claimed in claim 13, wherein a current origin of a current flow which is transmitted between the electrodes is arranged in the at least one region.

15. The apparatus as claimed in claim 13, wherein an energy beam having a temporally variable intensity, can be oriented toward one of the electrodes in such a way that a high energy can be transmitted directly into the at least one region.

16. The apparatus as claimed in claim 15, wherein a light beam is used as the energy beam.

17. The apparatus as claimed in claim 13, wherein the at least one region is arranged such that at least one insulator present between the electrodes is positioned outside the movement paths of the debris particles that are produced.

18. The apparatus as claimed in claim 13, wherein the current flow and/or the energy beam can be oriented in a direction of the opening, toward a side of the electrodes which is remote from the opening.

19. The as claimed in claim 18, wherein the at least one remote side of the first electrode is arranged with respect to the second electrode in such a way that a line running along the surface of the remote side meets a surface of the second electrode.

20. The apparatus as claimed in claim 13, wherein at least one of the electrodes is provided with a device for setting the temperature which is higher than or more or less equal to the melting temperature of the working gas.

21. The apparatus as claimed in claim 13, wherein the current flow and/or the energy beam can be oriented toward the at least one region where the electrodes are at a small distance from one another.

22. The apparatus as claimed in claim 13, wherein an optical device is arranged behind the opening, in a propagation direction of the radiation and outside the movement paths of the debris particles.

23. The apparatus as claimed in claim 22, wherein the optical device is arranged in a second module.

24. The apparatus as claimed in claim 13, wherein the at least one region is arranged in a depression or on a protrusion of the electrodes.

25. The apparatus as claimed in claim 13, wherein the electrodes are arranged within a first module.

26. The apparatus as claimed in claim 25, wherein an energy beam source which provides the energy beam is fixedly or removably arranged on or in the first module.

* * * * *